US006447362B2

(12) United States Patent
Khamphilavong et al.

(10) Patent No.: US 6,447,362 B2
(45) Date of Patent: Sep. 10, 2002

(54) ROTATING MUSICAL REMOTE CONTROL MOBILE DEVICE WITH DETACHABLE TOYS

(76) Inventors: Lisa Khamphilavong, 2222 Mt. Herman Rd., Murfreesboro, TN (US) 37127; Alisha Khamphilavong, 128 Constitution Ave., La Vergne, TN (US) 37086

( * ) Notice: Subject to any disclaimer, the term of this patent is extended or adjusted under 35 U.S.C. 154(b) by 0 days.

(21) Appl. No.: 09/859,493

(22) Filed: May 18, 2001

Related U.S. Application Data

(60) Provisional application No. 60/206,235, filed on May 23, 2000.

(51) Int. Cl.[7] ..... A63H 33/00

(52) U.S. Cl. ..... 446/227; 446/242; 446/265; 40/455

(58) Field of Search ..... 40/414, 455, 466, 40/473; 446/227, 236, 242, 265; 248/229.15, 214, 231.71

(56) References Cited

U.S. PATENT DOCUMENTS

| | | | | |
|---|---|---|---|---|
| D254,860 S | | 4/1980 | Chase et al. | D21/65 |
| 4,363,181 A | | 12/1982 | Hyman et al. | 40/466 |
| D273,405 S | | 4/1984 | Raffo et al. | D21/65 |
| D281,433 S | | 11/1985 | Chrones | D17/24 |
| D290,655 S | | 6/1987 | Thomson et al. | D24/45 |
| 4,756,109 A | * | 7/1988 | Marcus | 40/455 |
| D349,735 S | | 8/1994 | Cacciola et al. | D21/63 |
| 5,352,145 A | * | 10/1994 | Raiffe et al. | 24/457 |
| D371,170 S | | 6/1996 | Melandow | D21/63 |
| 5,672,088 A | * | 9/1997 | Chininis | 248/229.15 |
| 5,803,786 A | | 9/1998 | McCormick | 446/227 |
| 5,951,360 A | | 9/1999 | Fearon et al. | 446/227 |
| 6,113,455 A | * | 9/2000 | Whelan et al. | 248/214 |

FOREIGN PATENT DOCUMENTS

| | | |
|---|---|---|
| GB | 567847 | 5/1942 |
| WO | 90/08582 | 8/1990 |

* cited by examiner

*Primary Examiner*—Jacob K. Ackun
(74) *Attorney, Agent, or Firm*—Richard C. Litman

(57) ABSTRACT

A rotating musical remote control baby mobile device. The baby mobile device has a base attached to a crib or piece of furniture. The device also includes a music box, an extending arm and rotatable bear attached to the arm. The mobile has several animal figures that can be removed from the mobile using snap hooks or hook and loop fasteners. These individual animal figures can be safely given to an infant or newborn for holding or teething. The baby mobile device can also be controlled by an infrared remote control that can be attached to a piece of furniture or conveniently hung by a foldable handle on a door knob.

9 Claims, 6 Drawing Sheets

ROTATING MUSICAL REMOTE CONTROL MOBILE DEVICE WITH DETACHABLE TOYS

CROSS-REFERENCE TO RELATED APPLICATION

This application claims the benefit of U.S. Provisional Patent Application Serial No. 60/206,235, filed May 23, 2000.

BACKGROUND OF THE INVENTION

1. Field of the Invention

The present invention relates to a rotating musical remote control mobile device with detachable toys, e.g., animal figures.

2. Description of Related Art

Toys can be very important to get an infant's attention and to stimulate that infant's brain activity. Scientists have shown that bright and contrasting colors and shapes are best to stimulate infants, especially newborns. Further studies have shown that these factors combined with distinctive sounds and noises create an ideal environment for the proper physical and emotional development of an infant.

The related art describes a number of devices that can be used to stimulate an infant or newborn. U.S. Pat. No. Des. 254,860 issued to Chase et al. outlines a grasping and handling toy rattle to be used by an infant or newborn. This rattle is designed to get the attention of an infant or newborn while being safe to handle and play with.

U.S. Pat. No. Des. 349,735 issued to Cacciola et al. outlines a more sophisticated infant toy in the form of a mobile used together with a crib. The toy is designed to be attached to a crib and hang over the crib and above the infant. The infant can then reach up and touch toys hanging from the mobile, being stimulated by the sight and the movement of the toys.

U.S. Pat. No. Des. 371,170 issued to Melandow outlines a musical mobile that is also designed to be attached to a crib and hang over the crib and above the infant. Using a hanging animal figure, the mobile has the added feature of playing music to further stimulate and get the attention of an infant or newborn.

U.S. Pat. No. 4,363,181 issued to Hyman et al. also outlines the use of a musical mobile. The mobile is provided with hanging ornaments that are rotated by a motor that are tied into an electronic circuit. The electronic circuit also simultaneously controls a loudspeaker to produce a wide variety of music with variations in tune, tonal quality, key, tempo and loudness.

U.S. Pat. No. 5,803,786 issued to McCormick also outlines the use of a musical mobile. The mobile is also mounted to a crib or playpen by a resilient shaft that will move under the influence of vibrations from a motor, which is used to rotate a hanging ornament. A tape recorder or sound chip is incorporated into the device and is voice activated, which can be adjusted to play soothing music automatically when an infant wakes up.

U.S. Pat. No. 5,951,360 issued to Fearon et al. outlines the use of a musical mobile that utilizes a compact disc and cassette player. The mobile is also mounted on the side of an infant's crib or playpen and has a variety of ornaments that hang over the infant. The mobile can be used to play music continuously or can self-actuate in response to the infant's sounds or movements. There is also an infrared remote control used with this device as well.

The devices described in the Fearon et al. patent, the McCormick patent and the Hyman et al. patent utilize various features regarding the movement and music from a mobile. The devices described in these patent are very useful, but can be improved with the use of ornaments that can be removed from the mobile and be used as separate toys. That is what is really needed, a musical rotating mobile that has ornaments that can be removed from the mobile and used as separate toys.

None of the above inventions and patents, taken either singly or in combination, is seen to describe the instant invention as claimed.

SUMMARY OF THE INVENTION

The invention is a rotating musical remote control baby mobile device. The baby mobile device has a base that is attached to a crib or piece of furniture. The device also includes a music box, an extending arm and a rotatable bear attached to the arm. The mobile has several animal figures that can be removed from the mobile using snap hooks or hook and loop fasteners. These individual animal figures can be safely given to an infant or newborn for holding or teething. The baby mobile device can also be controlled by an infrared remote control that can be attached to piece of furniture or conveniently hung by a foldable handle on a door knob.

Accordingly, it is a principal object of the invention to provide a baby mobile device that has removable toy figures that can be separately played with by a newborn or infant.

It is another object of the invention to provide a baby mobile device that can be operated by a remote control.

It is a further object of the invention to provide a baby mobile device that has removable toy figures that also function as rattles.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
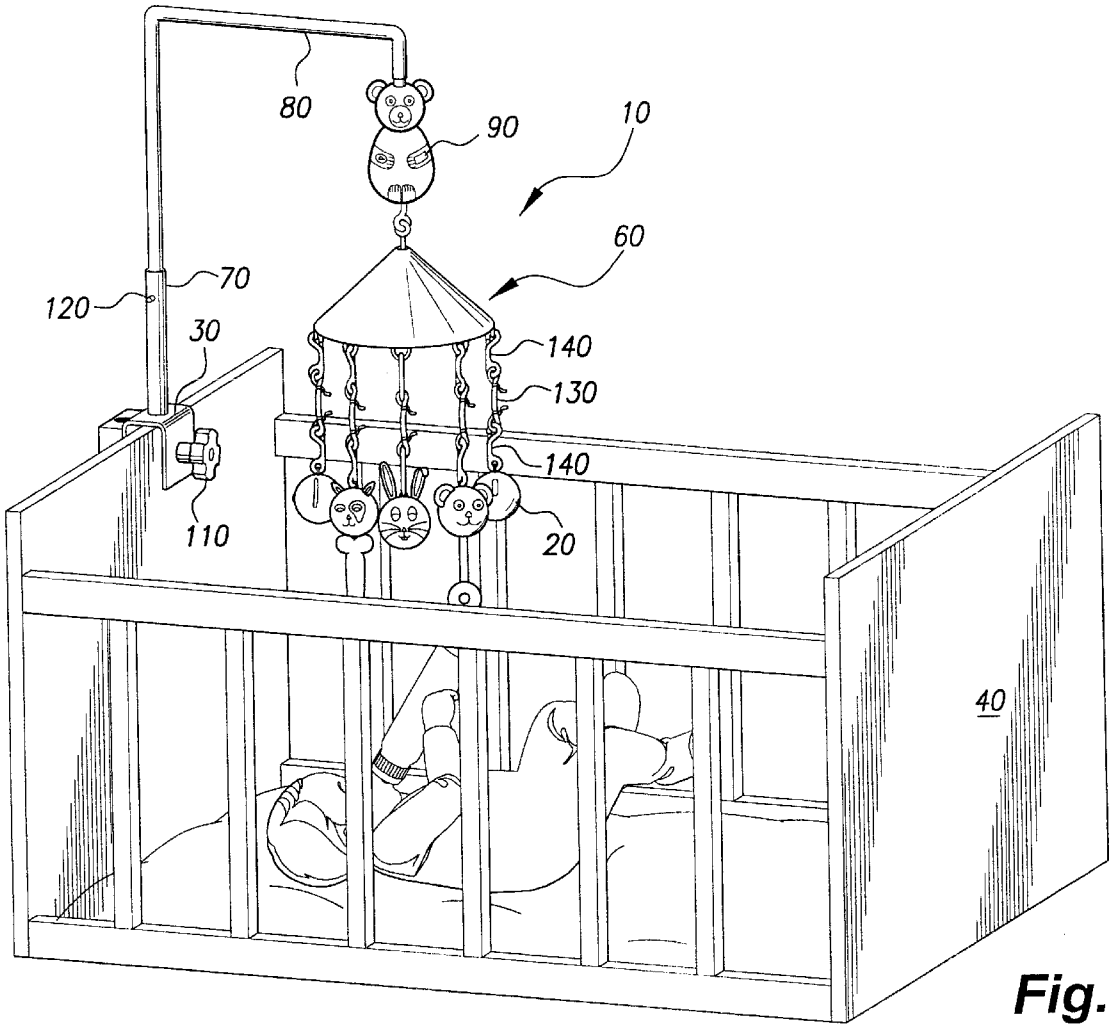
FIG. 1 is an environmental, perspective view of a musical remote control mobile device with detachable toys according to the present invention.

The present invention is a rotating musical remote control baby mobile device 10 with detachable animal figures 20, as depicted in FIG. 1. The baby mobile device 10 is comprised of a base 30 that is attached to a baby's crib or other piece of furniture 40 by a fastening means for fastening the base 30 to the baby's crib or piece of furniture 40. A battery pack (not shown) powers an electric motor and a music box that rotates the baby mobile 60 and plays music while the baby mobile 60 is rotating is also provided.

A lower support arm 70 extending upwards from the base 30, and a connecting means for connecting the lower support arm 70 to an upper support arm 80 that extends outward and over the baby's crib or other piece of furniture 40 is also provided. A rotating bear 90 is snapped into place on the end of the upper support arm 80 with the rotating bear's 90 tail being a removable holding means for holding a plurality of toy animal figures 20. There is also an on and off switch (not shown) as well as an "auto" setting that is used on the rotating bear 90, which automatically shuts off after 10 minutes of music being played.

The baby mobile device 10 has a fastening means, which is a fastening clamp 110. The baby mobile device 10 also has a connecting means, which is a spring loaded button and eyelet 120. The lower support arm 70 can be separated from the upper support arm 80 by depressing the spring loaded button and eyelet 120 and manually pulling apart the lower support arm 70 from the upper support arm 80.

Figure 2:
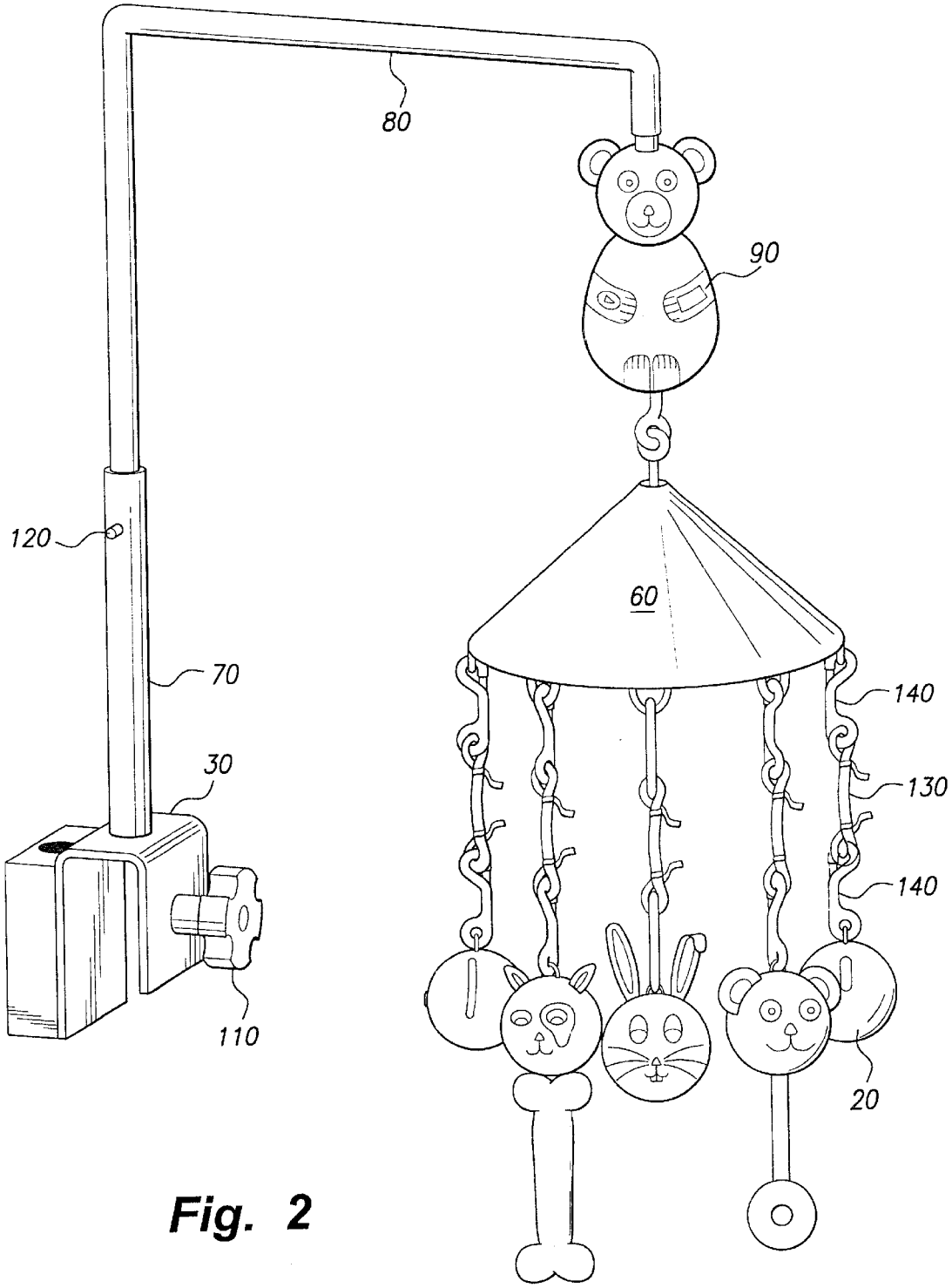
FIG. 2 is a perspective view of a musical remote control mobile device according to the present invention.
Figure 3A:
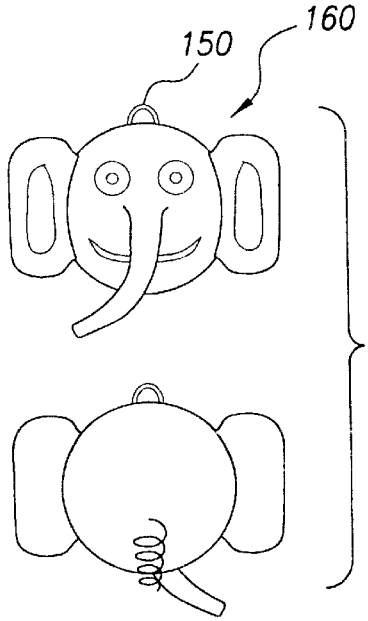
FIGS. 3A, 3B, 3C, 3D and 3E are perspective views of removable animal figures according to the present invention.
Figure 3B:
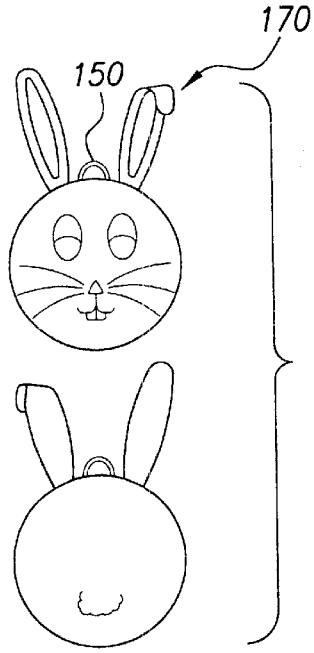
Figure 3C:
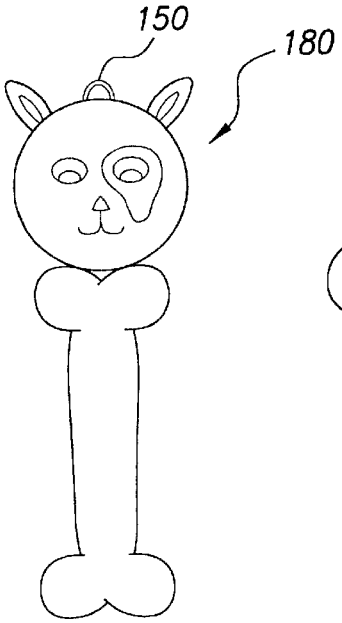
Figure 3D:
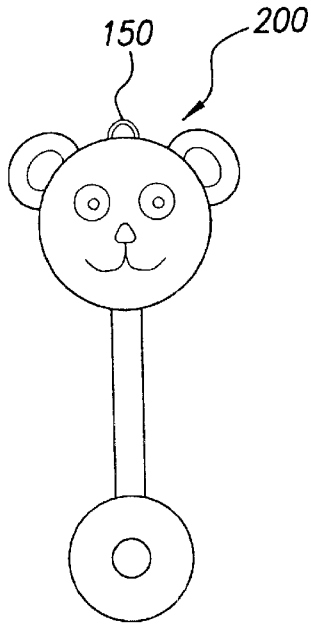
Figure 3E:
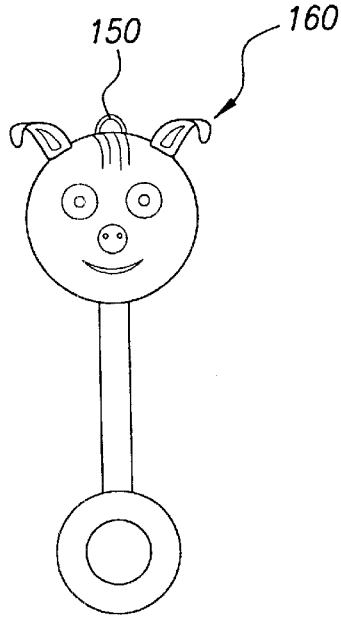

As shown in FIG. 2, the baby mobile device 10 has a removable holding means, which are strips of ribbon 130 with a snap hook 140 attached to each end of one of the ribbons 130. These snap hooks 140 attach each animal figure 20 to the ribbon 130 and can release each animal figure 20. The snap hooks 140 are connected to a ribbon loop 150 provided at the top of each animal figure 20, as shown on each of the animal figures 20 in FIGS. 3A–3E.

The plurality of detachable animal figures 20 include an elephant 160, a rabbit 170, a puppy 180, a bear 190 and a pig 200. Each animal figure 20 will have a plush outer cloth coating and thermoplastic exterior and will also include a rattle bell (not shown) within each of the animal figures 20. Each animal figure 20 can be safely handled for infants to teeth and play with and can be unclasped by hand with the snap hooks 140.

Figure 4:
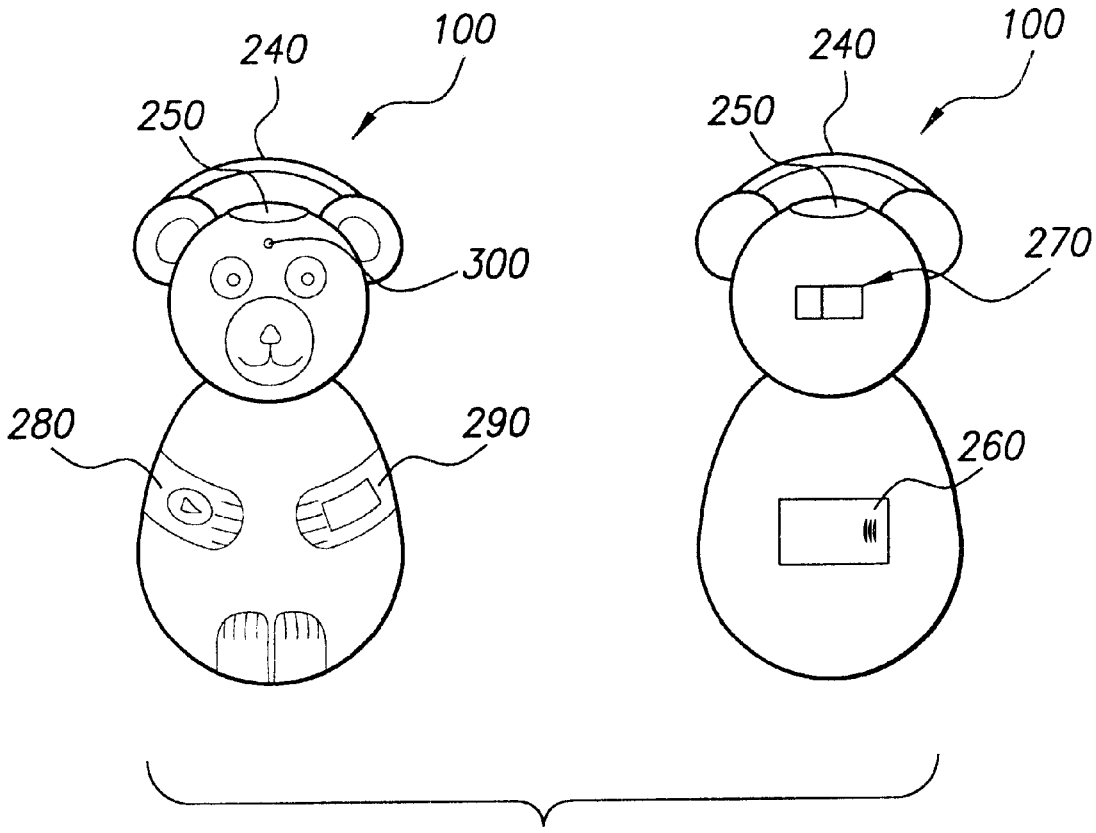
FIG. 4 is a perspective view of a remote control according to the present invention.

The remote control 100 has a hanging means, which is a foldable handle 240, as depicted in FIG. 4. This foldable handle 240 can be used to hang the remote control 100 from a protruding object, such as a door knob, and can be folded back when not in use.

The remote control 100 is an infrared signaling device 250 that works in combination with an infrared receiving device (not shown) located on the rotating bear 90. This is technology that is well-known to those schooled in the related art. The remote control 100 is in the shape of a bear and is provided with a battery pack 260 and a sliding on and off switch 270. A play button 280 and stop button 290 are also provided on each arm of the remote control 100. There is also a signaling light 300 to indicate when the infrared signaling device 250 is activated.

Figure 5:
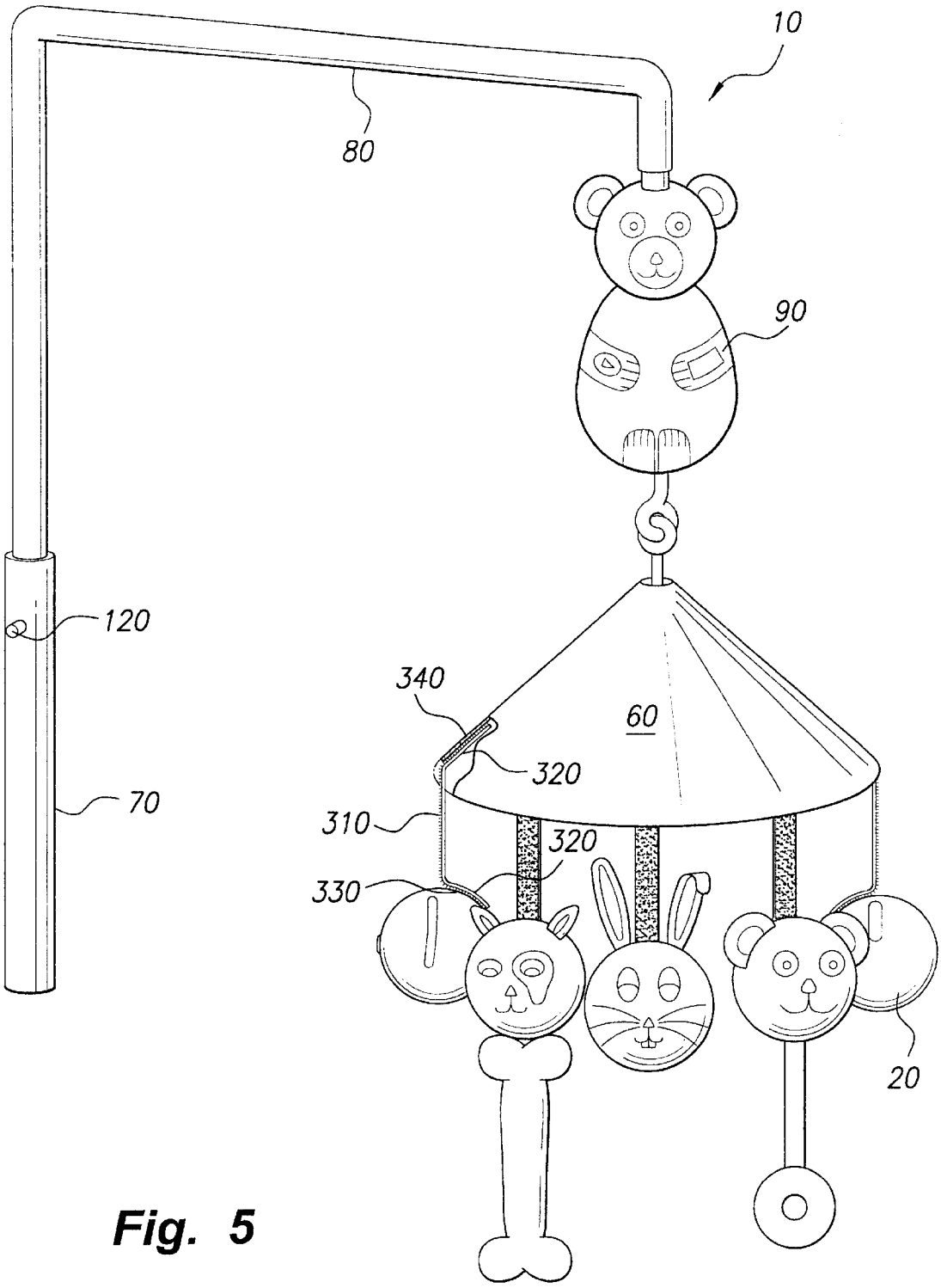
FIG. 5 is an isolated perspective view of a musical remote control according to the present invention.

The baby mobile device 10 has a second removable holding means, which is a ribbon 310 with a hook and loop fastener attached to each end of the ribbon 320. Each detachable animal figure 20 is also provided with the other end of a hook and loop fastener 330 as does the edge of the baby mobile 340. This is a second embodiment of the baby mobile device 10 and is depicted in FIG. 5.

Figure 6:
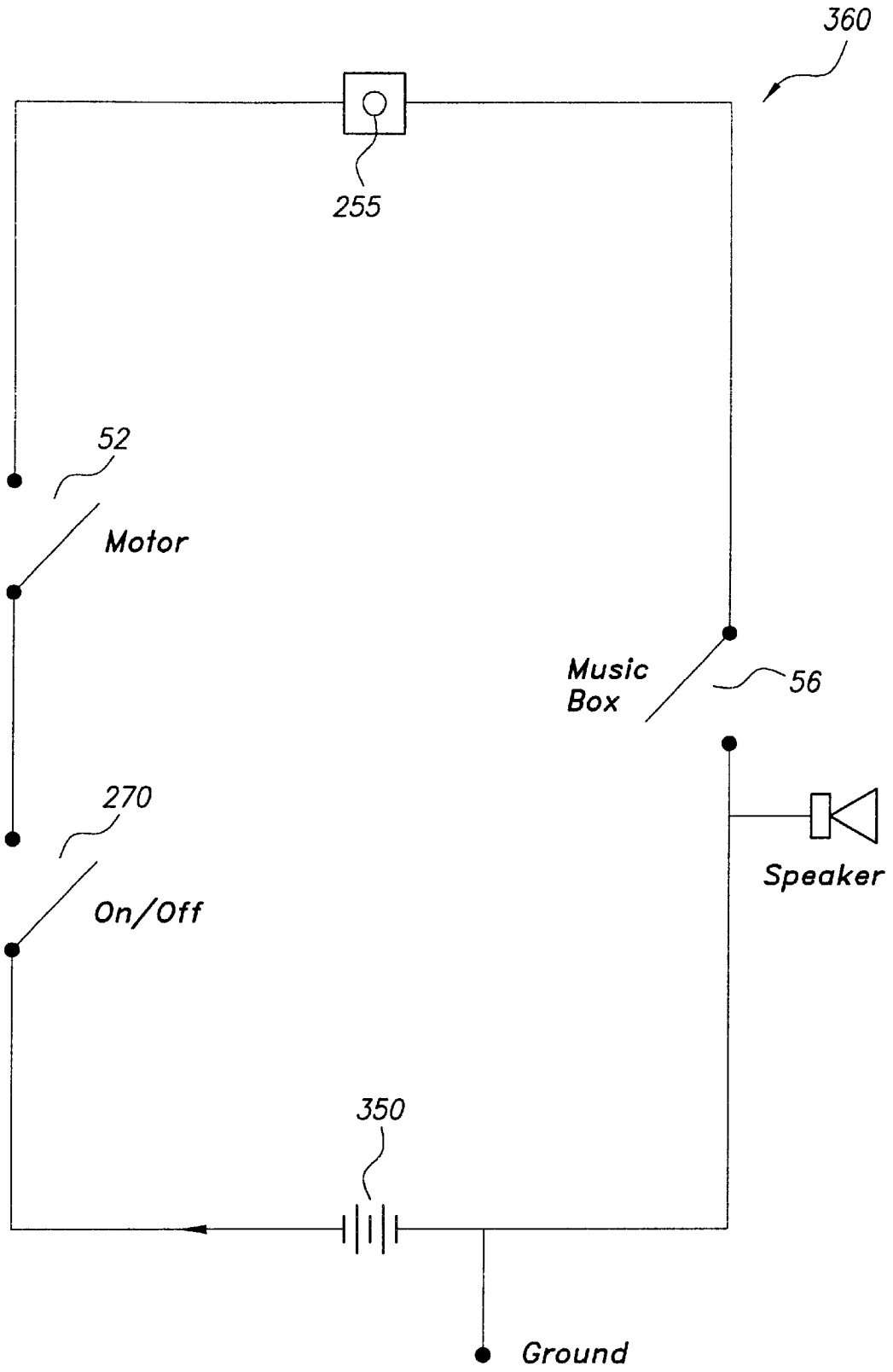
FIG. 6 is an electrical diagram of a musical remote control according to the present invention.

FIG. 6 is an electrical schematic 360 of the invention 10. The electrical schematic 360 illustrates the motor 52, the infrared receiving area 255, the music box 54, the speaker 56, a power source 350 and the on/off switch 270.

Operation and use of the baby mobile device 10 is uncomplicated. Activation of the baby mobile device 10 can be done manually with the on and off switch 270 or by remote control 100. The detachable animal figures 20 can be attached and removed as desired by the user, using either snap hooks 140 or hook and loop fasteners 320. The base 30 of the baby mobile device 10 is attached to a baby's crib or piece of furniture 40 by a fastening clamp 110, which is also adjusted manually by the user. The baby mobile 60 also rotates and plays music automatically when activated.

It is to be understood that the present invention is not limited to the embodiments described above, but encompasses any and all embodiments within the scope of the following claims.

We claim:

1. A rotating musical remote control baby mobile device with detachable animal figures, comprising:

a base, dimensioned and configured to be attached to a baby's crib or similar piece of furniture;

an electric motor and a music box that rotate a baby mobile and plays music while the baby mobile is rotating;

a lower support arm extending upwardly from the base;

a connecting means for connecting the lower support arm to an upper support arm that extends outward and over the baby's crib or other piece of furniture;

a distribution disk with a removable holding means for holding a plurality of toy animal figures to the distribution disk; and a remote control in the shape of an animal figure, provided with a hanging means for hanging the remote control.

2. The baby mobile device according to claim 1, wherein said fastening means is a fastening clamp.

3. The baby mobile device according to claim 1, wherein said connecting means is a spring loaded button and eyelet.

4. The baby mobile device according to claim 1, wherein said removable holding means is a ribbon with a snap hook attached to each end of the ribbon.

5. The baby mobile device according to claim 1, wherein said plurality of toy animal figures include an elephant, a rabbit, a puppy, a bear and a pig.

6. The baby mobile device according to claim 1, wherein said hanging means is a foldable handle.

7. The baby mobile device according to claim 1, wherein said remote control is an infrared signaling device and the base of the baby mobile device has an infrared receiving device.

8. The baby mobile device according to claim 1, wherein said removable holding means is a ribbon with a hook and loop fastener attached to each end of the ribbon.

9. The baby mobile device according to claim 1, wherein the toy animal figures are provided with a bell.

* * * * *